United States Patent [19]

Laursen

[11] Patent Number: 4,960,357

[45] Date of Patent: Oct. 2, 1990

[54] MOBILE FORK LIFTING APPARATUS

[75] Inventor: Jens Laursen, Lemvig, Denmark

[73] Assignee: JL Forklift Truck A/S, Lemvig, Denmark

[21] Appl. No.: 216,318

[22] Filed: Jul. 7, 1988

[30] Foreign Application Priority Data

Jul. 31, 1987 [DK] Denmark ..... 4023/87

[51] Int. Cl.[5] ..... B66F 9/14

[52] U.S. Cl. ..... 414/667; 414/671

[58] Field of Search ..... 414/667, 666, 670, 671, 414/664, 668; 294/119.1

[56] References Cited

U.S. PATENT DOCUMENTS

| | | | |
|---|---|---|---|
| 2,782,065 | 2/1957 | Lord | 294/119.1 X |
| 2,782,066 | 2/1957 | Lord | 294/119.1 X |
| 3,424,328 | 1/1969 | Gideonen et al. | 414/667 X |
| 3,930,587 | 1/1976 | Bliss | 414/664 |
| 4,279,564 | 7/1981 | Weinert | 414/667 X |
| 4,392,772 | 7/1983 | Reeves | 414/667 |
| 4,392,773 | 7/1983 | Johannson | 414/667 |
| 4,556,359 | 12/1985 | Sinclair | 294/119.1 X |
| 4,718,814 | 1/1988 | Addleman | 414/664 X |

FOREIGN PATENT DOCUMENTS

| | | | |
|---|---|---|---|
| 748320 | 12/1966 | Canada | 414/667 |
| 3007899 | 9/1981 | Fed. Rep. of Germany | 414/668 |
| 3421621 | 12/1985 | Fed. Rep. of Germany | 414/667 |
| 3515524 | 11/1986 | Fed. Rep. of Germany | 414/671 |
| 84/02563 | 7/1984 | PCT Int'l Appl. | 414/670 |
| 1011496 | 4/1983 | U.S.S.R. | 414/671 |
| 1279946 | 12/1986 | U.S.S.R. | 414/664 |

*Primary Examiner*—David A. Bucci
*Assistant Examiner*—Robert S. Katz
*Attorney, Agent, or Firm*—Scully, Scott, Murphy & Presser

[57] ABSTRACT

A mobile lifting apparatus, such as a fork truck or a fork lift, comprises a fork carriage vertically displaceable along guides in a mast, the fork carriage comprising two parallel, horizontal transverse girders. The two transverse girders guide and support two L-shaped forks, each transverse girder having a roller bracket with rollers at the top and bottom end of its body, the roller brackets rolling on the top and bottom transverse girder. The forks are displaceable on the transverse girders by corresponding hydraulic cylinders connected between the fork in question and the fork carriage. At least one of the transverse girders is a substantially U-shaped section bar, and at least one cylinder, preferably both cylinder, is arranged in substantially the recess of the section bar. As a result the hydraulic cylinders do not impede the view of the driver onto the operating area of the forks. At the same time the cylinders are more protected against external influences, such as shocks and impacts from the load on the forks.

6 Claims, 2 Drawing Sheets

MOBILE FORK LIFTING APPARATUS

FIELD OF THE INVENTION

The invention relates to a mobile lifting apparatus, such as a fork truck or a fork lift, comprising a fork carriage vertically displaceable along guides in a mast, said fork carriage comprising two parallel, horizontal transverse girders for guiding and supporting two L-shaped forks, each having a roller bracket with rollers at the top and bottom end of its body, said roller brackets rolling on the top and bottom transverse girder, and said forks being displaceable on the transverse girders by means of corresponding hydraulic cylinders connected between the fork in question and the fork carriage.

BACKGROUND ART

Lifting apparatuses of the above type are known, where the hydraulic cylinders are mounted in the area between the horizontal girders. This arrangement is disadvantageous as the hydraulic cylinders impede the view of the driver onto the operating area of the forks. This is a great disadvantage for the driver, especially when the load is to be put into place, e.g. on the floor of a truck or other places, where space is restricted.

SUMMARY OF THE INVENTION

The object of the invention is to provide a lifting apparatus of the above type where the view of the driver is considerably improved.

The object of the invention is accomplished by the inventive lifting apparatus being characterized in at least one of the transverse girders being a substantially U-shaped section bar, and at least one cylinder, preferably both cylinders, being arranged substantially in the recess of said section bar.

As a result the hydraulic cylinders do not impede the view of the driver onto the operating area of the forks. At the same time the cylinders are more protected against external influences, such as shocks and impacts from the load on the forks.

According to the invention the top transverse girder is a substantially U-shaped section bar with the two cylinders being arranged in the recess of said section bar.

This embodiment is especially suitable for practical purposes.

Furthermore, according to the invention, the recess is closed by means of a screen having a longitudinal slot for receiving a connecting means between the cylinder in question and the fork.

As a result the cylinders are optimally protected against shocks and impacts as well as other influences, such as dust, dirt and water.

In another embodiment of the inventive lifting apparatus, where the top transverse girder is a bar having a U-shaped cross section having its open end facing horizontally, and the top roller bracket comprises at least one horizontally rotatable first roller, the tread of said roller abutting the top surface of the top web of the section bar, and at least one vertically rotatable second roller, the tread of said roller abutting the back surface of the section bar, a horizontally rotatable roller is connected to the body of the fork below the top roller bracket, the tread of said roller abutting the bottom surface of the bottom web of the top girder.

Thus the rollers of the roller bracket always abut the top transverse girder, preventing the forks from vibrating or jolting during operation and thus generating harmful noises when said forks are not under load.

BRIEF DESCRIPTION OF THE DRAWINGS

Further characteristics of the inventive mobile lifting apparatus appear from the subclaims and below, where the invention is described in greater detail and with reference to the accompanying drawings, in which

DESCRIPTION OF THE PREFERRED EMBODIMENTS

Figure 1:
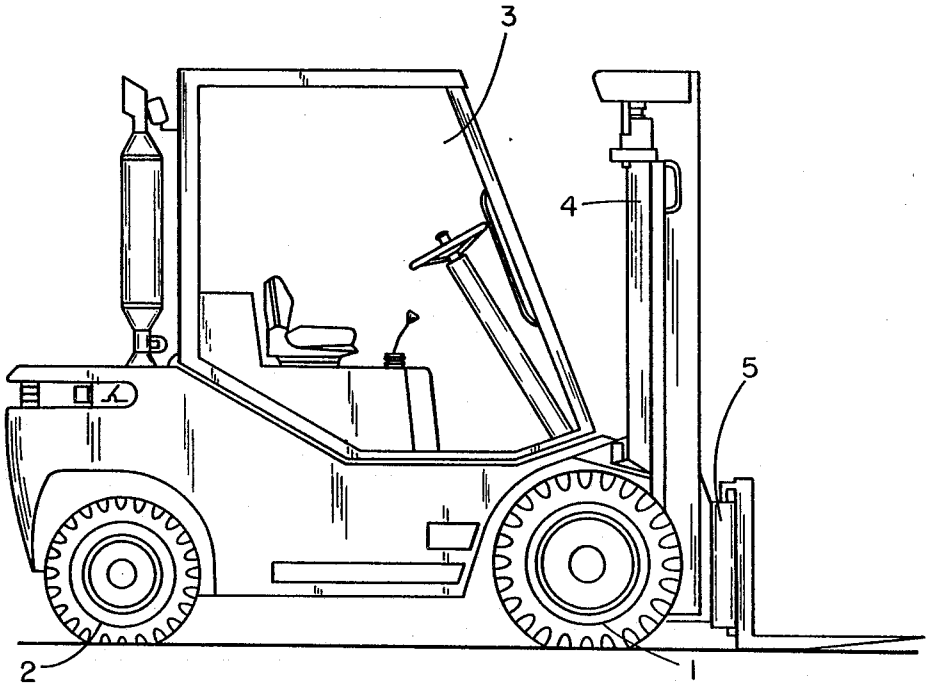
FIG. 1 is a side view of an inventive mobile lifting apparatus in form of a fork lift.
Figure 3:
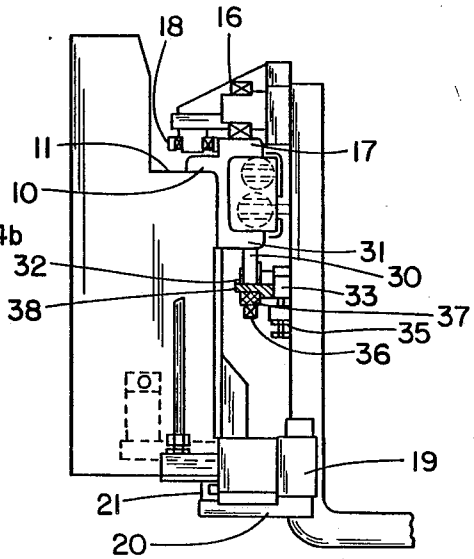
FIG. 3 is a left end view of the fork carriage of FIG. 2.

FIG. 1 shows a fork lift comprising a set of front wheels 1 and a set of back wheels 2, a driver's cab 3, and a mast 4 mounted in the front, said mast carrying and guiding a vertically displaceable fork carriage 5. As is clearly apparent from FIGS. 2 and 3, the fork carriage 5 comprises two plate shaped, vertical back parts 6*a*, 6*b* guided in the mast 4. Chain mounting means 7*a*, 7*b* are welded to the bottom part of the back parts 6*a*, 6*b*, a chain (not shown) being fastened onto each mounting means in a manner known per se. The back parts 6*a*, 6*b* are welded together with two parallel, mutually spaced, horizontal transverse girders 8, 9. The top transverse girder 8 is a bar of a substantially U-shaped cross section having its open end facing horizontally, and having a third web facing backwards and abutting steps 11 on the back parts 6*a*, 6*b* (only the step of the back part 6*a* is visible in the drawing). The bottom transverse girder 9 is of a substantially square cross-section and fastened to the back parts 6*a*, 6*b* close to their bottom ends.

The horizontal transverse girders 8, 9 together guide and support the L-shaped forks 12*a*, 12*b*. The top end of the bodies 13*a*, 13*b* of the each fork includes a top roller bracket 14, and the bottom end of the bodies of each fork includes a bottom roller bracket 15. The top roller bracket 14 comprises a first roller pair 16, rotatable about horizontal axes, the treads of said rollers abutting the external surface of the top web 17 of the top transverse girder 8, and at least a second roller pair 18 rotatable about vertical axes, the treads of said rollers 18 abutting the back surface of the body of the top transverse girder 8 directly above the third web 10 connected thereto The bottom roller bracket 15 comprises a third. roller pair 19 rotatable about vertical axes, the treads of said rollers abutting the external surface of the bottom transverse girder 9. The bottom roller bracket 15 comprises furthermore a support plate 20 extending past the bottom transverse girder 9 at the bottom surface of said transverse girder. On its side facing the bottom transverse girder 9 the support plate is provided with a sliding plate. At its external end the support plate 20 is further provided with a ridge 21 extending parallel to the bottom transverse girder 9. The ridge ensures that the fork is not lifted off the transverse girders 8, 9, e.g. when the fork carriage 5 is completely lowered, i.e. the forks are supported by the ground and the truck drives backwards.

Figure 2:
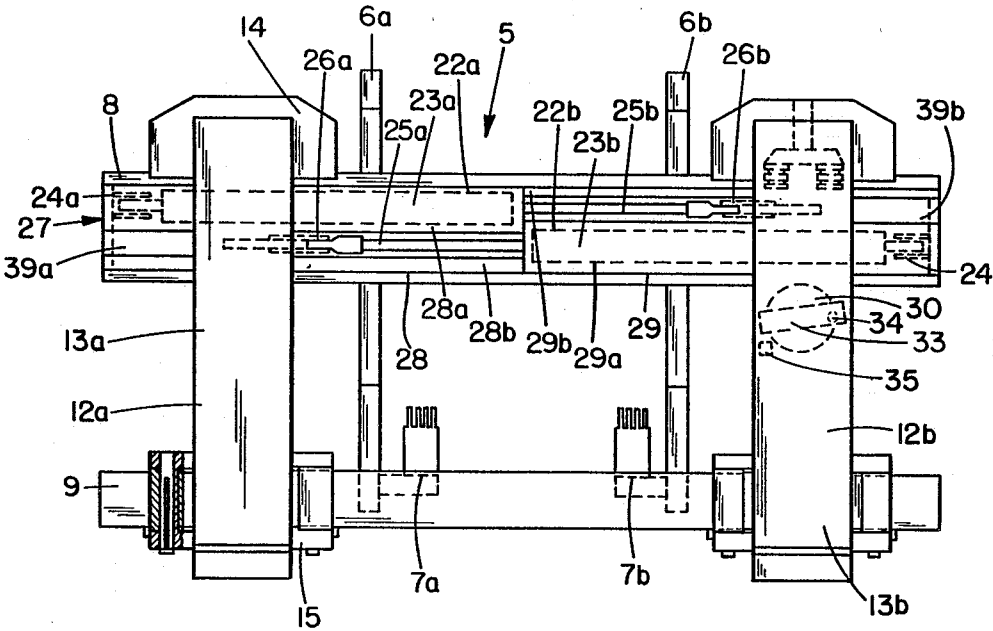
FIG. 2 is a front view of a fork carriage of the fork lift of FIG. 1 with forks mounted thereon.

The L-shaped forks 12*a* and 12*b* are displaceable along the transverse girders by means of their corresponding hydraulic cylinders 22a, 22b mounted in the recess of the top transverse girder 8. At the external end of the cylinder housing 23a the hydraulic cylinder 22a, i.e. the top cylinder in FIG. 2, is connected with a cylinder mounting means 24a fastened to the left-hand end of the transverse girder, cf. FIG. 2. The external end of the piston rod 25b of the cylinder is connected with the right-hand fork 12b, cf. FIG. 2, by means of a connecting means 26b fastened to the body 13b of the fork 12b. As a result, the fork 12b is displaceable on the right-hand half of the transverse girders 8, 9, cf. FIG. 2. Correspondingly, the left-hand fork 12a is displaceable on the left-hand half of the transverse girders 8, 9, cf. FIG. 2, by means of the bottom hydraulic cylinder 22b. At its external end the cylinder housing 23b of said bottom cylinder is fastened to the right-hand end of the top transverse girder by means of a cylinder mounting means 24b, cf. FIG. 2. At its external end the piston rod 25a of the bottom hydraulic cylinder 22b is fastened to the body 13a of the left-hand fork 12a by means of a connecting means 26a, cf. FIG. 2.

The recess of the top transverse girder 8 is covered by means of a screen 27 comprising a left-hand screen part 28 covering the left-hand part of the recess of the top transverse girder 8, and a right-hand screen part 29 covering the right-hand part of the recess of the top transverse girder 8. Each of the screen parts 28, 29 comprises a large screen section 28a, 29a fastened to the top transverse girder 8 by not-shown means in such a way that the sections substantially cover the cylinder housing 23a of the top cylinder 22a and the the cylinder housing 23b of the bottom cylinder 22b, respectively. Furthermore the screen parts 28, 29 comprise small screen sections 28b, 29b fastened to the top transverse girder 8 by not-shown means in such a way that between a small section and its corresponding large section 28a, 29a a longitudinal slot 39a, 39b is formed for receiving the connecting means 26a, 26b between the left-hand hydraulic cylinder 22a and the right-hand fork 12b, and between the right-hand hydraulic cylinder 22b and the left-hand fork 12a, respectively, cf. FIG. 2. The screen 27 comprising four screen parts 28a, 29a, 28b, 29b protects both cylinders against physical influences, such as shocks and impacts, as well as dust, dirt and water etc. At the same time it is a safty means against personal injuries.

A roller 30 is connected with the right-hand body 13b of the L-shaped fork 12b, cf. FIG. 2, the tread of said roller abutting the bottom surface of the bottom web 31 of the top transverse girder or U-shaped section bar 8. The roller is rotatable around a first axis of rotation 32 connected to an arm 33. The external end of said arm is rotatably journaled on a shaft journal 34 permanently connected with the body 13bof the fork 12b. The end of the arm 33 opposite the shaft journal 34 is influenced by an adjustment screw arrangement so that the axis of rotation of the roller 30 rotates around the shaft journal 34 and the tread of the roller 30 abuts the bottom web 31 of the U-shaped section bar 8. The roller 30 comprises a roller bearing 36, cf. FIG. 3, the internal ring of which is mounted on a resilient sleeve 37, e.g. a sleeve including two rings with a resilient material such as rubber, inbetween. The sleeve 37 is mounted on a shaft 38 acting as the axis of rotation 32 of the roller 30. By using a resilient sleeve 37 the roller 30 is adjustable in such a way that inaccuracies of the bar 8 do not prevent the sleeve from abutting the bottom web and thus from pressing the first roller pair 16 of the top roller bracket 14 against the top transverse girder. At the same time the resilient sleeve 37 enables an unmachined section bar to be used as the top transverse girder 8.

I claim:

1. A mobile fork lifting apparatus comprising:

a mast;

a fork carriage connected to the mast and supported by said mast for vertical movement therealong, and including top and bottom parallel horizontal transverse girders;

left and right fork assemblies supported for horizontal transverse movement along the girders, each fork assembly including (i) an L-shaped body, (ii) a top roller sub assembly connected to the L-shaped body of the fork assembly and supported for rolling movement along the top girder, and (iii) a bottom roller subassembly connected to the L-shaped body of the fork assembly and supported for rolling movement along the bottom girder;

a first extensible hydraulic cylinder connected to the fork carriage and to the left fork assembly to move said left fork assembly horizontally along the transverse girders; and a second extensible hydraulic cylinder connected to the fork carriage and to the right fork assembly to move said right fork assembly horizontally along the transverse girders;

wherein at least one of the girders has a U-shaped cross-section forming a forwardly facing recess, and at least one of the hydraulic cylinders is arranged at least substantially in said recess;

wherein the fork carriage further comprises (i) a screen connected to said one girder and substantially covering said recess, (ii) first connecting means connecting the first hydraulic cylinder to the left fork assembly, and (iii) second connecting means connecting the second hydraulic cylinder to the right fork assembly; and wherein the screen forms a longitudinal slot, and one of said connecting means extends through said longitudinal slot.

2. A fork lifting apparatus according to claim 1, wherein:

said one of the girders is the top girder; and both of said hydraulic cylinders are arranged at least substantially in said recess.

3. A fork lifting apparatus according to claim 1, wherein:

said one of the hydraulic cylinders includes a cylinder housing and a piston rod; and the fork carriage further comprises (i) mounting means connecting said cylinder housing to said one of the girders, and (ii) connecting means connecting said piston rod to one of the fork lift assemblies.

4. A fork lifting apparatus according to claim 1, wherein:

said one of the girders is the top girder, and said top girder includes horizontal top and bottom surfaces, and a back vertical surface; and the top roller subassembly of at least one of the fork assemblies includes (i) a first roller connected to the L-shaped body of said one fork assembly, supported for rotation about a horizontal axis, and engaging and supported by the top surface of the top girder for rolling movement therealong, (ii) a second roller connected to the L-shaped body of said one fork assembly, supported for rotation about a vertical axis, and engaging the back surface of the top girder for rolling movement therealong, and (iii) a third roller connected to the L-shaped body of said one fork assembly, supported for rotation about a horizontal axis, and engaging the bottom surface of the top girder for rolling movement therealong.

5. A fork lifting apparatus comprising:

a mast;

a fork carriage connected to the mast and supported by said mast for vertical movement therealong, and including top and bottom parallel horizontal transverse girders;

left and right fork assemblies supported for horizontal transverse movement along the girders, each fork assembly including (i) an L-shaped body, (ii) a top roller sub assembly connected to the L-shaped body of the fork assembly and supported for rolling movement along the top girder, and (iii) a bottom roller subassembly connected to the L-shaped body of the fork assembly and supported for rolling movement along the bottom girder;

a first extensible hydraulic cylinder connected to the fork carriage and to the left fork assembly to move said left fork assembly horizontally along the transverse girders; and a second extensible hydraulic cylinder connected to the fork carriage and to the right fork assembly to move said right fork assembly horizontally along the transverse girders;

wherein the top girder has a U-shaped cross-section forming a forwardly facing recess, and includes horizontal top and bottom surfaces and a back vertical surface, and at least one of the hydraulic cylinders is arranged at least substantially in said recess; and the top roller subassembly of at least one of the fork assemblies includes (i) a first roller connected to the L-shaped body of said one fork assembly, supported for rotation about a horizontal axis, and engaging and supported by the top surface of the top girder for rolling movement therealong, (ii) a second roller connected to the L-shaped body of said one fork assembly, supported for rotation about a vertical axis, and engaging the back surface of the top girder for rolling movement therealong, iii an arm connected to the L-shaped body of said one fork assembly for pivotal movement about a pivot axis, and iv a third roller connected to and rotatably supported by said arm for rotation about a horizontal axis spaced from said pivot axis, and engaging the bottom surface of the top girder for rolling movement therealong.

6. A fork lifting apparatus according to claim 5, wherein:

the top roller subassembly of said one of the fork assemblies further includes a shaft connected to said arm, and a resilient sleeve mounted on said shaft; and the third roller is mounted on said resilient sleeve to allow vertical movement of the third roller relative to said shaft as the third roller rolls along the top transverse girder.

* * * * *